US010974370B2

(12) United States Patent
Guillen et al.

(10) Patent No.: US 10,974,370 B2
(45) Date of Patent: Apr. 13, 2021

(54) MULTI-PRONGED TOOL

(71) Applicants: Marco Guillen, Homestead, FL (US); Anayadira Guillen, Homestead, FL (US)

(72) Inventors: Marco Guillen, Homestead, FL (US); Anayadira Guillen, Homestead, FL (US)

( * ) Notice: Subject to any disclaimer, the term of this patent is extended or adjusted under 35 U.S.C. 154(b) by 158 days.

(21) Appl. No.: 16/047,113

(22) Filed: Jul. 27, 2018

(65) Prior Publication Data

US 2019/0054598 A1 Feb. 21, 2019

Related U.S. Application Data

(60) Provisional application No. 62/546,103, filed on Aug. 16, 2017.

(51) Int. Cl.
*B25B 13/50* (2006.01)
*B25G 1/10* (2006.01)

(52) U.S. Cl.
CPC ..... *B25B 13/50* (2013.01); *B25G 1/102* (2013.01)

(58) Field of Classification Search
CPC ..... B25G 1/102; B25F 1/00; B25B 13/48; B25B 13/481; B25B 13/50; B25B 13/56
See application file for complete search history.

(56) References Cited

U.S. PATENT DOCUMENTS 2,421,665 A * 6/1947 Umbdenstock ..... B25B 13/02 81/119
2,802,259 A * 8/1957 Stoner ..... B25F 1/00 30/429
3,405,377 A 10/1968 Pierce
3,898,723 A * 8/1975 Kirby ..... A63H 18/02 29/270
4,037,275 A * 7/1977 Schor ..... B25F 1/00 81/437
4,580,469 A * 4/1986 Lordahl ..... B25F 1/00 81/437
4,621,738 A 11/1986 Delucchi
4,711,353 A 12/1987 Rozmestor
5,099,726 A * 3/1992 Hsiao ..... B25B 13/48 81/177.2
5,562,006 A * 10/1996 Pelosi, Jr. ..... B25B 13/00 81/119
5,652,988 A * 8/1997 Appelhoff ..... B25F 1/00 7/151
5,653,818 A * 8/1997 Genardi ..... A63F 3/068 134/6
5,819,610 A * 10/1998 Brannan ..... B25B 13/48 81/437
6,092,655 A 7/2000 Ernst
(Continued)

*Primary Examiner* — David B. Thomas
(74) *Attorney, Agent, or Firm* — Boudwin Intellectual Property; Daniel Boudwin

(57) ABSTRACT

A multi-pronged tool configured to remove plugs of HVAC units. The multi-pronged tool has a member having a first end and a second end. A plurality of rectangular protrusions extends from each end and each lateral side thereof, wherein each protrusion is designed to pair with a plug of an HVAC unit. One or more apertures are on a surface of the member, wherein each aperture is designed to pair with a connector of an HVAC unit. In this way, a user is able to easily remove or apply a plurality of different drain plugs of HVAC units.

11 Claims, 3 Drawing Sheets

(56) References Cited

U.S. PATENT DOCUMENTS

| | | | | |
|---|---|---|---|---|
| 6,505,532 | B1 * | 1/2003 | Lawson | B25B 13/48 81/124.3 |
| 6,938,523 | B1 * | 9/2005 | Farrey | B25B 13/04 81/124.4 |
| 7,107,880 | B2 * | 9/2006 | Kitchen | B25B 13/02 81/119 |
| 7,117,766 | B1 * | 10/2006 | Boehringer | B25B 13/5091 81/121.1 |
| 7,874,034 | B1 * | 1/2011 | Mack | B25B 13/02 7/138 |
| 8,230,766 | B2 | 7/2012 | Chang | |
| 2004/0020334 | A1 * | 2/2004 | Kish | B25B 13/48 81/437 |
| 2004/0020336 | A1 * | 2/2004 | Farrell | B25B 13/48 81/461 |
| 2006/0011016 | A1 * | 1/2006 | Potts | B25B 13/48 81/15.9 |
| 2011/0247953 | A1 * | 10/2011 | Edwards | B25F 1/00 206/373 |

* cited by examiner

MULTI-PRONGED TOOL

CROSS REFERENCE TO RELATED APPLICATIONS

This application claims the benefit of U.S. Provisional Application No. 62/546,103 filed on Aug. 16, 2017. The above identified patent application is herein incorporated by reference in its entirety to provide continuity of disclosure.

BACKGROUND OF THE INVENTION

The present invention relates to a multi-pronged tool configured to remove drain plugs. More specifically, the present invention provides a planar member having a perimeter and a plurality of protrusions extending therefrom, including a plurality of apertures disposed on the planar member.

Many homes and companies have HVAC units that require drain pans, which require drain plugs. Unfortunately, HVAC units are made by a variety of different manufacturers, which leads to a variety of different drain plugs used. This leads to HVAC maintenance workers or homeowners searching for multiple types of different tools to remove the variety of drain plugs, creating extensive frustration and a waste of time for the user. Additionally, often the plugs and threaded connectors are installed tightly and require excessive effort to remove, thereby increasing the risk of injury or damage to the HVAC unit. Therefore, a multi-pronged tool adapted to easily remove or install common drain plugs on varying HVAC units is needed.

SUMMARY OF THE INVENTION

In view of the foregoing disadvantages inherent in the known types of multi-pronged tools now present in the known art, the present invention provides a multi-pronged tool wherein the same can be utilized for providing convenience for the user when desiring to remove a plurality of different drain plugs in HVAC units.

The present system comprises a multi-pronged tool configured to remove drain plugs of HVAC units, comprising a member having a first end and a second end. A plurality of rectangular protrusions extends from each end and each lateral side thereof, wherein each protrusion is configured to pair with a plug of an HVAC unit. One or more apertures are disposed on a surface of the member, wherein each aperture is configured to pair with a connector of an HVAC unit. In this way, a user is able to easily remove or apply a plurality of different drain plugs of HVAC units.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
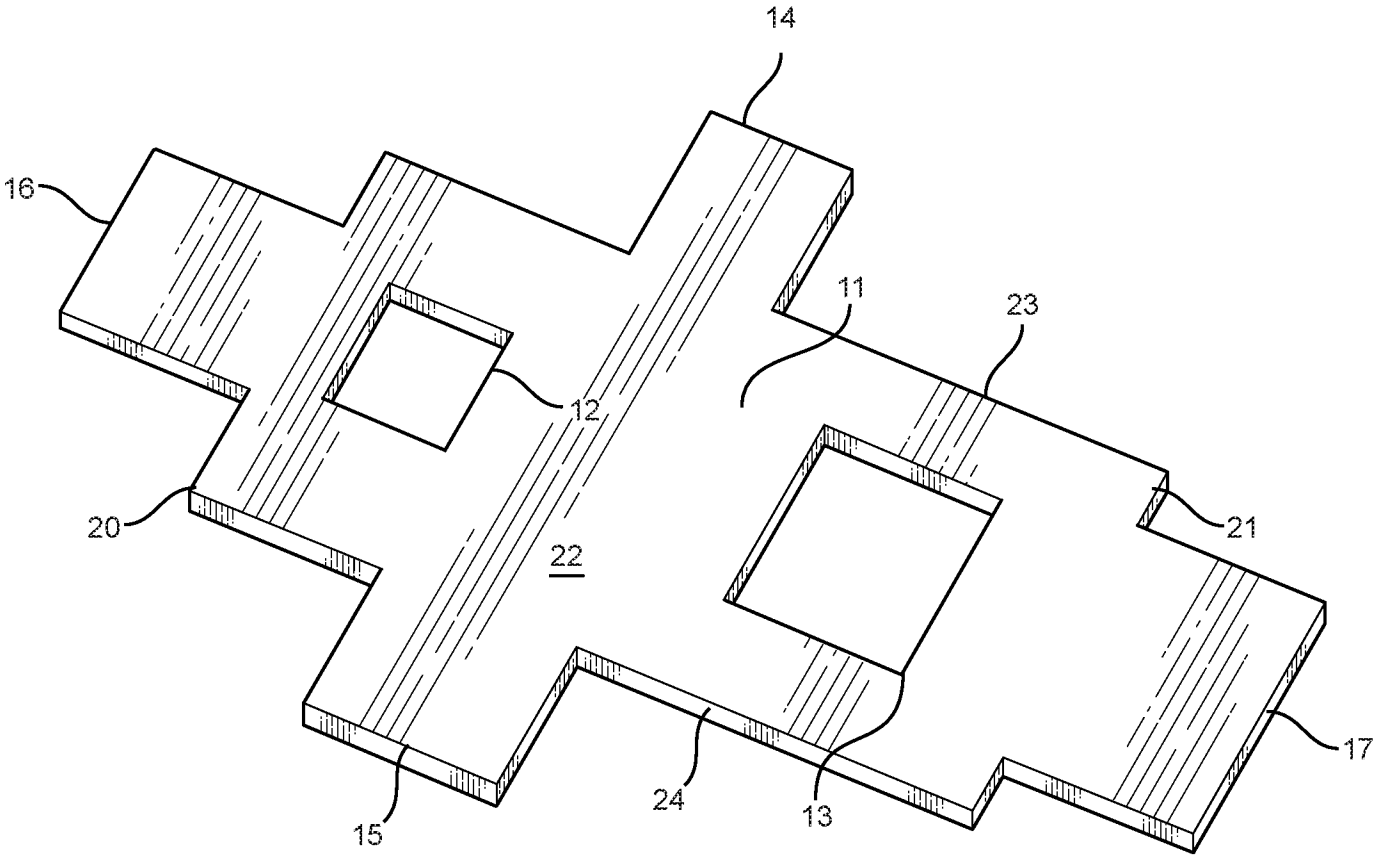
FIG. 1 shows a perspective view of an embodiment of the multi-pronged tool.

Reference is made herein to the attached drawings. Like reference numerals are used throughout the drawings to depict like or similar elements of the multi-pronged tool. The figures are intended for representative purposes only and should not be considered to be limiting in any respect.

Figure 2:
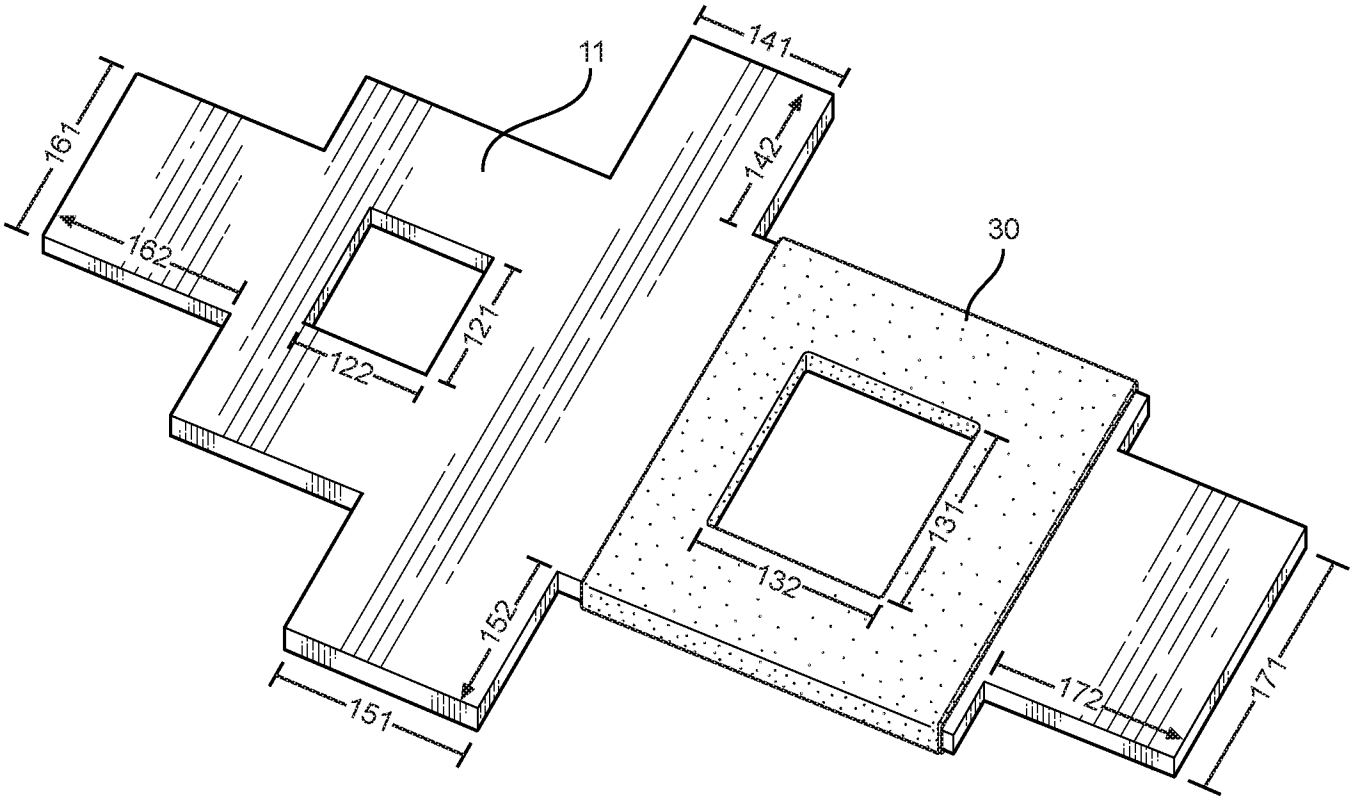
FIG. 2 shows a perspective view of an embodiment of the multi-pronged tool having a grip.

Referring now to FIG. 1 and FIG. 2, there is shown a perspective view of an embodiment of the multi-pronged tool an embodiment of the multi-prong tool having a grip. A multi-pronged tool comprises a member 11 having a first end 20 and a second end 21 as well as a first lateral side 23 and a second lateral side 24. The multi-pronged tool is composed of aluminum in the illustrated embodiment, however in other embodiments the multi-pronged tool is composed of plastic or other suitably durable material. In the shown embodiment, the member 11 is rectangularly shaped, however in other embodiments the member 11 can comprise any suitable stable geometric shape, such as an elliptical. In the illustrated embodiment, the member 11 is planar and comprises a uniform thickness, however in other embodiments, the member 11 is thicker at one end than at the opposing end, thereby providing greater structural integrity at the thicker end.

A plurality of rectangular protrusions extends from both the first end 20 and the second end 21 as well as the first lateral side 23 and the second lateral side 24. In the illustrated embodiment there are a total of four protrusions, however in other embodiments there are more than four protrusions. Each protrusion is configured to match a slot for the female connection of a plug used on a drain pan of an HVAC system, and thereby configured to fit within the plug. As such, each protrusion is linear.

In the illustrated embodiment, one protrusion extends from the first and second lateral sides 23, 24 of the member 11, with a first protrusion 14 on one side and a second protrusion 15 disposed on the opposite side. The first end 20 has a third protrusion 16 whereas the second end 21 has a fourth protrusion 17. In the illustrated embodiment, the first and second protrusions 14, 15 are paired and are disposed to each have one edge align with one another across an axis, wherein the first and second protrusions 14, 15 are closer to the first end 20 than the second end 21. In one embodiment, however, the first and second protrusions 14, 15 are disposed to mirror one another at the center of the member 11, as opposed to disposed closer to the first end 20 than the second end 21, or, in a different embodiment, disposed closer to the second end 21 than the first end 20. In another embodiment, the first protrusion 14 is disposed on the same lateral side as the second protrusion 15. In a further embodiment, the first protrusion 14 is disposed on one side and the second protrusion 15 is disposed on the opposite side diagonal to the first protrusion 14.

Further, each of the protrusions is planar and comprises a uniform thickness. However, the protrusions differ in other embodiments. In one embodiment, the protrusions may be ridged or otherwise non-planar in form to provide a greater frictional hold on the plug each protrusion is configured to match. In another embodiment, the thickness of each protrusion is tapered, wherein the protrusion is thickest at the edge adhering to the member 11 and decreasing as it extends out, such that each protrusion is provided a greater structural integrity. In the shown illustration, the first protrusion 14 comprises a thickness that is equivalent to the second, third, and fourth protrusions 15, 16, and 17, which is additionally equivalent to the thickness of the member 11, such that the thickness of the multi-pronged tool is uniform throughout. However, in other embodiments, each protrusion varies in height such that the first protrusion 14 is thicker than the member 11, the second protrusion 15 is thicker than the first protrusion 14, the third protrusion 16 is thicker than the second protrusion 15, and the fourth protrusion 17 is thicker than the third protrusion 16.

In the illustrated embodiment, the first protrusion 14 has a first length 142, wherein the first length 142 is the distance the first protrusion 14 extends out from the member 11, thereby forming two sidewalls 143. Additionally, the first protrusion 14 has a first width 141, wherein the first width 141 is the distance between each sidewall 143. Similarly, the second protrusion 15 has a second length 152 and a second width 151 between the two sidewalls 153. The third protrusion 16 has a third length 162 and a third width 161 between the two sidewalls 163. The fourth protrusion 17 has a fourth length 172 and a fourth width 171 between the two sidewalls 173.

In the shown embodiment, the first, second, third, and fourth widths 141, 151, 161, and 171 each comprise a different value, such that fourth width 171 is greater than the third width 161 which is greater than the second width 151 which is greater than the first width 141. In this way, the width 171 of the fourth protrusion 17 has the greatest value and the width 141 of the first protrusion 14 has the smallest value. Thereby, the plurality of widths with each protrusion allows the user a plurality of options when removing the plugs of an HVAC drain pan. In the shown embodiment, each protrusion is square, wherein each length and each width are equivalent to one another, such that an overall size of the multi-pronged tool is kept as small as possible. However, in other embodiments each protrusion is rectangular such that each length and each width are not equivalent, thereby providing a greater amount of leverage when used by a person.

One or more apertures is disposed on a surface of the member 11. In the illustrated embodiment there are two apertures, however in other embodiments there is only one aperture. Each aperture is configured to match a head for the male connection of a plug used on a drain pan of an HVAC system, and as such comprises a square or rectangular shape configured to receive a plug head therein.

In the illustrated embodiment, a first aperture 12 is disposed at the first end 20 of the member 11, while a second aperture 13 is disposed at the second end 21 of the member 11. The first aperture 12 and second aperture 13 are both disposed along a central axis of the member 11 in the shown embodiment, however in other embodiments, the first aperture 12 and the second aperture 13 are further to the first lateral side 23 than the second lateral side 24 to allow the user greater space on the second lateral side 24 when gripping the member 11.

Further, the first aperture 12 and the second aperture 13 are both uniform throughout a surface of the respective perimeter of the respective aperture. In another embodiment, however, a ridge is disposed across the surface of the perimeter of the aperture, such that the aperture can provide a greater grip when used. In the illustrated embodiment, the first aperture 12 and the second aperture 13 extend completely through the surface of the member 11, such that the head of the plug extends therethrough the respective aperture when used. However, in other embodiments the first aperture 12 and second aperture 13 are inset into the surface of the member 11, such that the respective aperture covers the head of the plug when used.

The first aperture 12 has a width 121 and a length 122, wherein the length 122 is the distance along the first aperture parallel to the first and second lateral sides 23, 24 of the member 11. Similarly, the second aperture 13 has a width 131 and a length 132, wherein the length 132 is also measured as parallel to the first and second lateral sides 23, 24 of the member 11. In the shown embodiment, the second aperture 13 is larger than the first aperture 12, such that the width 131 and length 132 are greater than the width 121 and length 122, respectively. In other embodiments, however, the second aperture 13 is smaller than the first aperture 12. In the shown embodiment, the width 131 is equivalent to the length 132, as the width 121 is equivalent to the length 122, such that the second aperture 13 and first aperture 12 are both square in shape. However, in other embodiments the first aperture 12 and second aperture 13 are rectangular such that the width is not equivalent to the length of the respective aperture.

In one embodiment, the multi-pronged tool comprises an ergonomic grip, having a padding 30 therearound. In this way, it is more comfortable for a user to grasp and turn the multi-prong tool when using. In one embodiment, the padding 30 is disposed along a portion of a perimeter of the member 11, specifically along only the lateral sides of the member 11 wherein the padding 30 does not overlap with any one protrusion of the plurality of protrusions or any one aperture of the one or more apertures. In the illustrated embodiment, the padding 30 extends over a portion of the member 11, such that the second aperture 13 is covered in the padding 30, however the padding 30 is configured not to interfere with the ability of the second aperture 13 to receive a plug head therein. In another embodiment, the padding 30 covers the entire surface of the member 11, such that the protrusions exude from the padding 30, and the apertures are inset as a solid mold within the surface of the padding 30.

Figure 3:
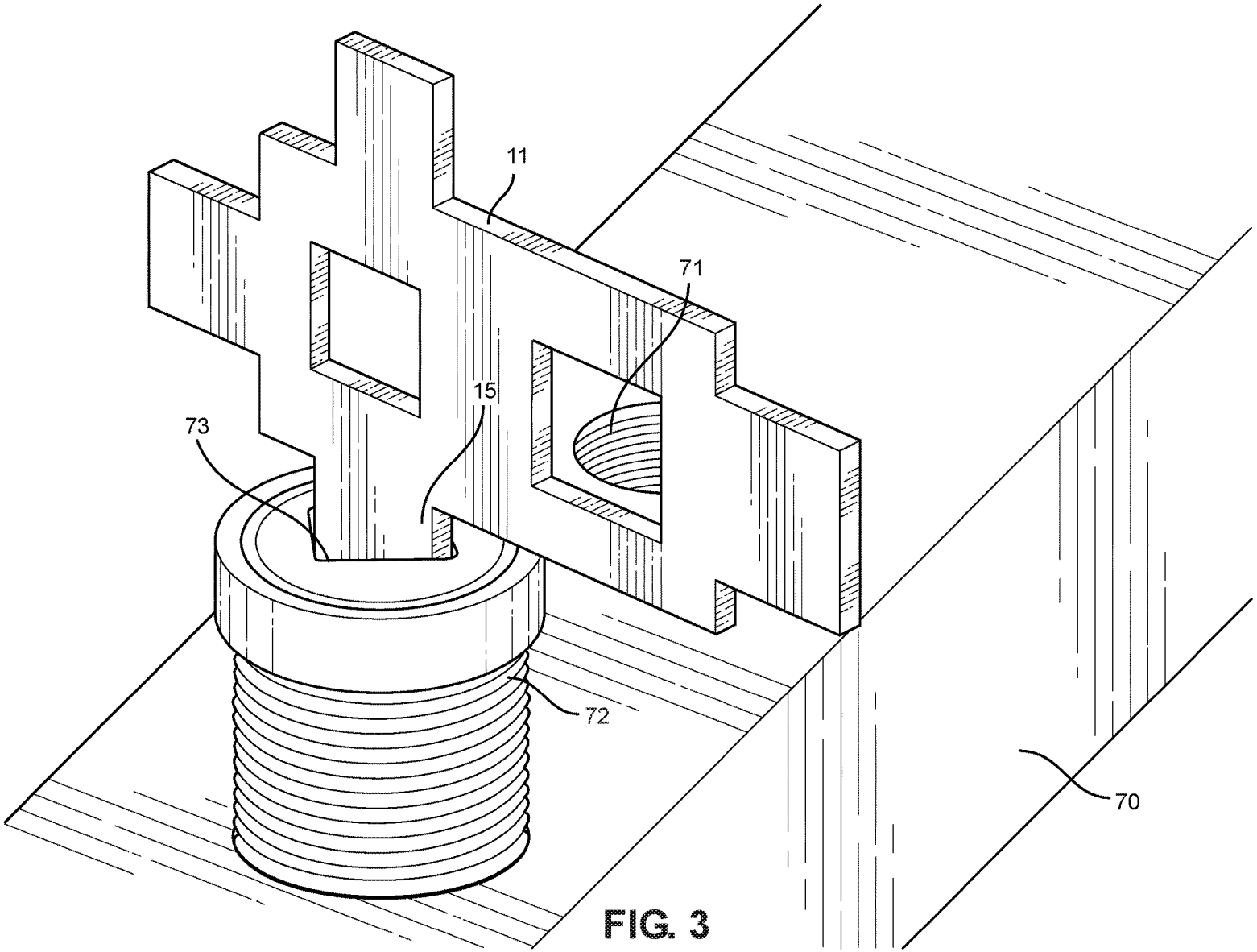
FIG. 3 shows a perspective view of an embodiment of the multi-pronged tool rotated and in use.

Referring now to FIG. 3, where is shown an embodiment of the multi-prong tool in use. In operation, having a drain pan 70 for an HVAC system a user will desire to install or remove a plug 72 from a piping 71 inside the drain pan 70. For a plug with a female head, the user will insert the appropriately sized protrusion 15 of the multi-pronged tool 11 into the slot 73 of the plug 72. In the illustrated embodiment, the plug 72 is threaded, such that it screws into the piping 71 of the drain pan 70. Thereby, the multi-prong tool provides the user greater leverage and torque when removing or installing the plug 72 than is otherwise provided by a traditional tool, such as a wrench. Thus, the multi-prong tool allows the user to install or remove the plug 72 without undue frustration or difficulty.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A multi-pronged tool, comprising:

a member having a first end and a second end;

a plurality of rectangular protrusions extending from each end and each lateral side thereof;

one or more apertures disposed on a surface of the member;

wherein a padding, configured to be gripped by a user, covers each lateral side of the member.

2. The multi-pronged tool of claim 1, wherein the member is planar.

3. The multi-pronged tool of claim 1, wherein the member is of uniform thickness.

4. The multi-pronged tool of claim 1, wherein each protrusion of the plurality of protrusions is of equal thickness.

5. The multi-pronged tool of claim 1, wherein the member is rectangular.

6. The multi-pronged tool of claim 1, wherein each aperture of the plurality of apertures extend therethrough the member.

7. The multi-pronged tool of claim 1, wherein the padding extends across a portion of the member.

8. The multi-pronged tool of claim 1, wherein each protrusion of the plurality of protrusions has a different width.

9. The multi-pronged tool of claim 1, wherein each protrusion of the plurality of protrusions has a length equal to the width of the respective protrusion.

10. The multi-pronged tool of claim 1, wherein there is a first aperture and a second aperture, each disposed such that one aperture is aligned with each end of the member.

11. The multi-pronged tool of claim 10, wherein a first aperture is larger than a second aperture.

* * * * *